US006817933B2

(12) United States Patent
Blick

(10) Patent No.: US 6,817,933 B2
(45) Date of Patent: Nov. 16, 2004

(54) FLEXIBLE DRESSABLE EDGE SUPPORT

(76) Inventor: John Blick, 31891 Circle Dr., S. Laguna, CA (US) 92677

( * ) Notice: Subject to any disclaimer, the term of this patent is extended or adjusted under 35 U.S.C. 154(b) by 18 days.

(21) Appl. No.: 10/280,623

(22) Filed: Oct. 25, 2002

(65) Prior Publication Data

US 2004/0082270 A1 Apr. 29, 2004

(51) Int. Cl.[7] ..... B24B 47/00
(52) U.S. Cl. ..... 451/388; 269/21
(58) Field of Search ..... 451/388, 365, 451/370, 391, 494; 269/21, 20

(56) References Cited

U.S. PATENT DOCUMENTS 5,433,657 A 7/1995 Bovone
5,562,276 A 10/1996 Blick
6,068,547 A * 5/2000 Lupi ..... 451/388
6,186,567 B1 2/2001 Blick
6,286,822 B1 * 9/2001 Blick ..... 269/21

* cited by examiner

*Primary Examiner*—Lee D. Wilson
(74) *Attorney, Agent, or Firm*—Curtis L. Harrington

(57) ABSTRACT

A plurality of spaced apart supports are designed to closely support a work piece immediately adjacent the edge being worked, ground or polished. Adjacent shear forced are also eliminated by the use of a polymeric interconnections used to both generally contribute to the spacing and to transmit the vacuum in a distributed manner among the individual support units. The top and bottom surfaces of the supports are dressably machineable in place on the working table to insure that all are brought to exactly the same height to insure even support, and utilize a hardened rubber, or any other suitable machinable material which will not enable the work piece to displace significantly downwardly upon the application of vacuum. The tops and bottoms, as a group, are selectively operable. The ability to periodically dress both ends of the interconnected supports gives the user the power to continually insure that each interconnected support set is within a more exacting vertical tolerance. Further, the machineable ends can be removed and replaced.

9 Claims, 3 Drawing Sheets

FLEXIBLE DRESSABLE EDGE SUPPORT

FIELD OF THE INVENTION

The present invention relates to improvements in the field of work piece holding devices for machines. More specifically, the present invention relates to a multi-element vacuum hold down device which contains upper and lower dressable surfaces and a flexible vacuum transmission web in between the multiple elements and which is useful in supportably working thinner materials, especially for downward beveling grinding forces without failure or with extremely reduced incidence of failure.

BACKGROUND OF THE INVENTION

In many instances, it is necessary to locate, position and support a work piece which is to be milled, sanded, ground, etc. The precision and stability of the positional device is important, as is the ability to re-position the positional device. Positive location of work pieces which are relatively thick are described in U.S. Pat. No. 6,186,567 to John Blick entitled "Locator and Hold Down system for a Machine" which describes an integrated system for using multiple holders. A system for positive location and support of thin work pieces are described in U.S. Pat. No. 6,286,822 to John Blick entitled "MACHINABLE SUPPORTS FOR CLOSE TOLERANCE EDGE SUPPORT" and describes an integrated system for using multiple separately locatable holders where each holder has a base of sufficient dimension to both support and allow a user integrated placement of each separate holder. Pre-selected variations on shape degree of rigid spaced multiplicity were illustrated.

U.S. Pat. No. 5,433,657 to Luigi Bovone issued on Jul. 11, 2001 and entitled "DEVICE FOR FIXING AND MAINTAINING SHAPEABLE GLASS PLATES IN POSITION DURING THEIR MACHINING" discloses a rigidly pivotable series of fixed suction support elements having upper and lower vacuum areas for fixture to a work piece and a work table, respectively. However, the relationship between the suction support elements is based upon a complex hinge arrangement with machined passages in both the elements and the hinge portions. This arrangement is expensive and requires precision measurements both to make absolutely certain that the upper and lower vacuum support element are flush to the floor and work piece surface, as well as to insure that the hinge clearance is so closely tolleranced as to prevent undue vacuum degradation from leakage into the device.

The device of Bovone is heavy, bulky and difficult to place precisely about a work piece. Further, the Bovone device is not dressable to enable a greater precision of formation of the sealing and working height. Bovone recites "suckers" 11 which have no other further specification. The Bovone reference appears to indicate that "suckers" are metal structures. Thus height is controlled, but vacuum is not. Any nick on the "suckers" will cause further loss of vacuum. As a result, the structure of Bovone would have to be treated especially gently during handling.

Another problem with Bovone relates to the relatively rigid hinging between his support elements. Any twisting of the Bovone assembly, especially during handling could cause the entire series of supports to "bind". Where one end of the supports was angled with respect to the others, or where the hinge axis was shifted through mishandling, the angularity of the individual support elements could be forcibly mis-aligned as dictated by the tight hinge relationship between the individual support elements.

What is therefore needed is a support specially formulated to closely support a thin work piece near its edge, and which provides a series of independent vacuum support elements, which is precision dressable, and which can provide even, secure support to a work piece.

SUMMARY OF THE INVENTION

The devices and systems of the present invention encompass the provision of a plurality of spaced apart supports specially designed to closely support a work piece immediately adjacent the edge being worked, ground or polished, but especially an edge which is being beveled or some other type of material process where downward force is applied to the edge of the work piece. The top and bottom surfaces of the supports are machineable in place on the working table to insure that all are brought to exactly the same height to prevent adjacent supports from creating uneven support and adjacent shear forces. Adjacent shear forced are also eliminated by the use of a polymeric interconnections used to both generally contribute to the spacing and to transmit the vacuum in a distributed manner among the individual support units.

The top and bottom members of the supports are a hardened rubber, or any other suitable machinable material which will not enable the work piece to displace significantly downwardly upon the application of vacuum but which will provide a vacuum downward force from the work piece to the support and from the individual supports to the work table surface.

The hardened rubber top of the edge hold down are machinable without losing the ability to act as a vacuum hold down. Such machinability is often referred to as "dressability" and enables significant advantages along with the fact that the top and bottom of the individual supports are selectively operable.

A given set of interconnected supports can a selective vacuum applied to hold the sit of interconnected supports to the work table. The upper surfaces can be dressed. The same set of interconnected supports can be turned over with the now bottom ends of the interconnected supports held fast to the table to enable precision dressing of the now upwardly exposed surfaces.

The ability to periodically dress both ends of the interconnected supports gives the user the power to continually insure that each interconnected support set is within a more exacting vertical tolerance. The machineable ends can be removed and replaced. This will enable a user to insure that all of his supports are exactly the same height by having the ability to re-dress end contact support ends upon replacement.

Replacement of the dressable ends will typically be had for long term wear, and it is contemplated that where all the supports and support sets are dressed over time that the dressing operation will result in an updated new height figure which will be taken to account by an automated system in computing the heights of the grinding spindle.

Further, the support sets can be of various unit lengths to reduce the necessity for individual vacuum line connections. For example, a work piece having a 5 foot circumference could be served by a first set of supports having a length of three feet and a second set of supports having a length of two feet.

A collection of working support sets could be employed including several three to four foot lengths, several two foot lengths and several one foot lengths. Since each working support set shares an independently actuatable upper and lower vacuum actuation possibility, each working support in each set needs to be vacuum engaged at both ends. In other words, both ends of all the supports need to be engaged between the work piece and the work table. In the given lengths of the working support sets, supports which are in excess of the numbers needed to completely support the periphery of the work piece can be aligned to extend to the vast areas within the periphery of the work piece.

As a result, the user selected limitations of the supports within a given length of the set of working supports will only be limited by a user preference on the overall weight of the set to be moved about for a new setup and the numbers of vacuum lines for which independent control of each support set is desired.

Further, and since each work piece setup typically involves pulling a vacuum about the complete periphery simultaneously, the working support sets can be serially interconnected from one working support set to another so that actuation of a single working table vacuum connection will create a working table vacuum for all working support sets, and the actuation of a single work piece vacuum connection will create a work piece vacuum for all working support sets. Thus the only limitation should be a user limitation on the number of support units within a set based purely upon handling preferences.

Finally, the most impactive aspect of the work piece support set is its simplicity of design, standardization of component parts which translates into further utilization and facilitation of maintenance. Each support contains about ten basic components, of which four are identical, resulting in only six unique components per support. The support within each set which accepts vacuum will have two additional hose tap connectors. The end supports may also include a pair of set screws to block the further transmission of vacuum where the polymeric sleeve has openings.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
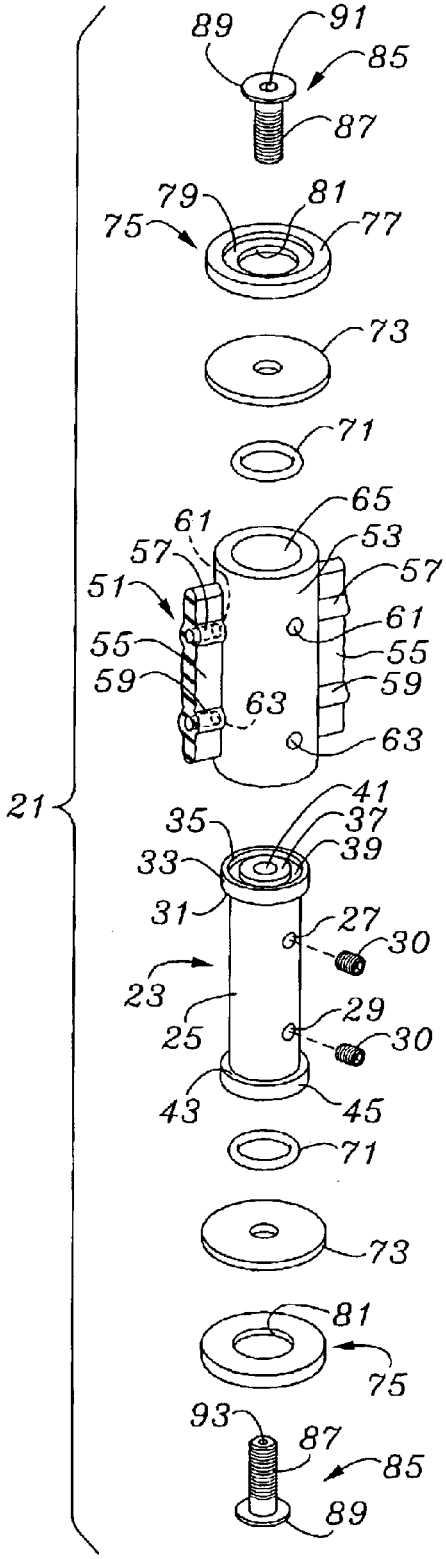
FIG. 1 is a perspective exploded view looking down at a single vacuum support of a series of vacuum sports used in the vacuum support set of the invention.

The description and operation of the invention will be best described with reference to prior art FIG. 1, which is a downward perspective exploded view of a single one of the double ended edge vacuum hold down supports 21, hereinafter referred to as a support element 21. Support element 21 includes a body 23 having a main cylindrical extent 25 and a pair of vacuum communication ports including an upper vacuum communication port 27 and a lower vacuum communication port 29. Ideally the ports 27 and 29 will include a straight through bore access extending straight through the body 23 and out the other side. This will especially be the case if support 21 is to both receive and upper and lower vacuum and to transmit both upper and lower vacuum to the next adjacent support 21.

Typically, the ports 27 and 29 will be threaded to enable them to be plugged with a threaded plug member 30 so that a user can selectively block entry into the body 23. This is desired where a user may have a set of supports 21 webbed together and want to effectively shorten the set by excising other supports 21. Where connections to the ports 27 and 29 are exposed, the threaded plug members 30 can be used to seal one side of the support 21.

The support has an upper annular cup shape which includes, from the main cylindrical extent 25, a radially outwardly extending surface 31, an outward radial surface 33, and an upper circumferentially outermost surface 35. A second circumferentially inward surface 37 is separated from outward radial surface 33 by a slot 39. Surface 37 is shown as generally even with surface 35. At the center of surface 37 a threaded bore 41 is seen.

Threaded bore 41 is in fluid communication with upper vacuum communication port 27 and a port on the opposite upper side of body 23. The bottom half of body 23 is a mirror image of the top half of body 23 and thus a threaded bore identical to threaded bore 41 is in fluid communication with lower vacuum communication port 29 and another port on the opposite upper side of body 23 (in alignment generally with port 29).

The details of the bottom half of body 23 which can be seen are a radially outwardly extending surface 43 and an outward radial surface 45.

Again referring to FIG. 21, the next component seen immediately above body 23 is a flexible elastomeric annular sleeve 51 having a cylindrical body portion 53 and one or two side web portions 55. Web portions 55 each support an upper vacuum channel 57 and a lower vacuum channel 59. At the point of approach of the cylindrical body portion 53, the vacuum channels 57 and 59 communicate with upper aperture 61 and lower aperture 63 which enable a fluid communication from the vacuum channels 57 and 59, through the upper and lower apertures 61 and 63 and into an inside bore 65 of the cylindrical body portion 53.

When the cylindrical body portion 53 is fitted over the body 23, the apertures 61 and 63 align with the upper and lower vacuum communication ports 27 and 29 respectively. A second web portion 55 extending to the left also includes the upper vacuum channel 57, and lower vacuum channel 59, as well as apertures 61 and 63 for communicating with the upper and lower vacuum communication ports on body 23 not seen in FIG. 1 and which are in communication with the ports 27 and 29.

The fitting of the cylindrical body portion 53, one or two side web portions 55, and upper and lower vacuum channels 57 and 59 is preferably done by molding. The material of choice is urethane which may be pumped around a mold cavity containing the aligned support bodies 23 with appropriate structures to form the side web portions 55, and upper and lower vacuum channels 57 and 59.

Where the element 21 is a terminal element, the left side web portion 55 may be eliminated. In other instances it may be excised from the cylindrical body portion 53 and the upper and lower vacuum communication ports corresponding to ports 27 and 29 respectively can be plugged with a threaded member.

Shown above the flexible elastomeric annular sleeve 51 is an "o" ring seal 71 for interfitting within the slot 29 and sealing against a plate 73 shown above the "o" ring seal 71. The plate 73 generally conforms to the round shape of the end of the body 23. Above the plate 73 is a hardened rubber dressable member 75, which can be made of any hard rubber capable of being machined, or any other suitable machinable material which will not enable a work piece to displace significantly downwardly upon the application of vacuum but which is flexible enough to provide a vacuum force. It is preferable for the hardened rubber dressable member 75 to be vulcanized to the upper surface of the plate 73 such that any additional hold down forces on the hardened rubber dressable member 75 will not be necessary.

The dressable member 75 has an upper annular surface 77 and an inner lower height annular surface 79. Inner lower height annular surface 79 surrounds an aperture 81. The thickness or height of the upper annular surface 77 above inner lower height annular surface 79 is the height of material which is available for precision dressability. Once the dressable member 75 upper annular surface 77 is worn, ground or cut away to the level of the inner lower height annular surface 79, the dressable member 75 should be replaced.

Above the dressable member 75 is a threaded member 85 having a threaded shaft 87 and a flat head 89 with a shaped opening 91, typically a hexagonal opening for operation with a hex wrench. The shaped opening 91 is in communication with a bore (not seen in the threaded member 85 shown in the upper portion of FIG. 1) which extends completely through to the end of the shaft of the threaded member 85.

Beginning at the bottom of the body 23, an identical set of components seen above the flexible elastomeric annular sleeve 51 are seen as "o" ring seal 71, plate 73, hardened rubber dressable member 75 (seen from its bottom side), and threaded member 85 with its threaded shaft 87, flat head 89 and a bore 93 which extends through to its shaped opening 91 (not seen in FIG. 1). Threaded member 85 through bore 93 enables it to transmit vacuum through to the space between inner lower height annular surface 79 and either a work piece surface or a support surface.

The threaded member 85 pulls the plate 73, which holds the hardened rubber dressable member 75, against the "o" ring seal 71 and into the slot 39. The combination enables vacuum source from the threaded bore 41 to be effectively communicated to the space between upper annular surface 77 and inner lower height annular surface 79.

Figure 2:
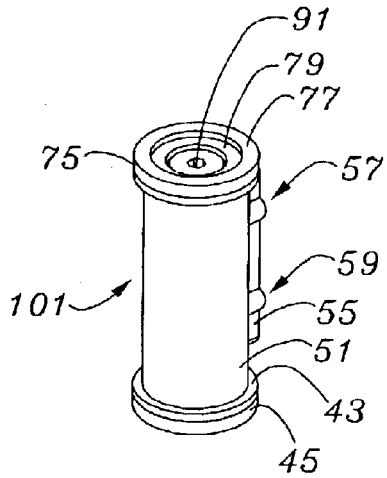
FIG. 2 is an assembled view of the single vacuum support seen in FIG. 1.

Referring to FIG. 2, an assembled view of the single vacuum support seen in FIG. 1 is seen from a perspective view, but absent the left side is a web portion 55, the upper and lower vacuum channels 57 and 59, associated apertures 61 and 63 and the upper and lower vacuum communication ports 27 and 29 which would be associated with the left side of the support 21.

As such, the support seen in FIG. 2 is an end support 101. Further, where the flexible elastomeric annular sleeve 51 has a cylindrical body portion 53 which covers over both the upper and lower vacuum communication ports 27 and 29, it may not be necessary to provide threaded plugs into the upper and lower vacuum communication ports 27 and 29 to prevent loss of vacuum.

Figure 3:
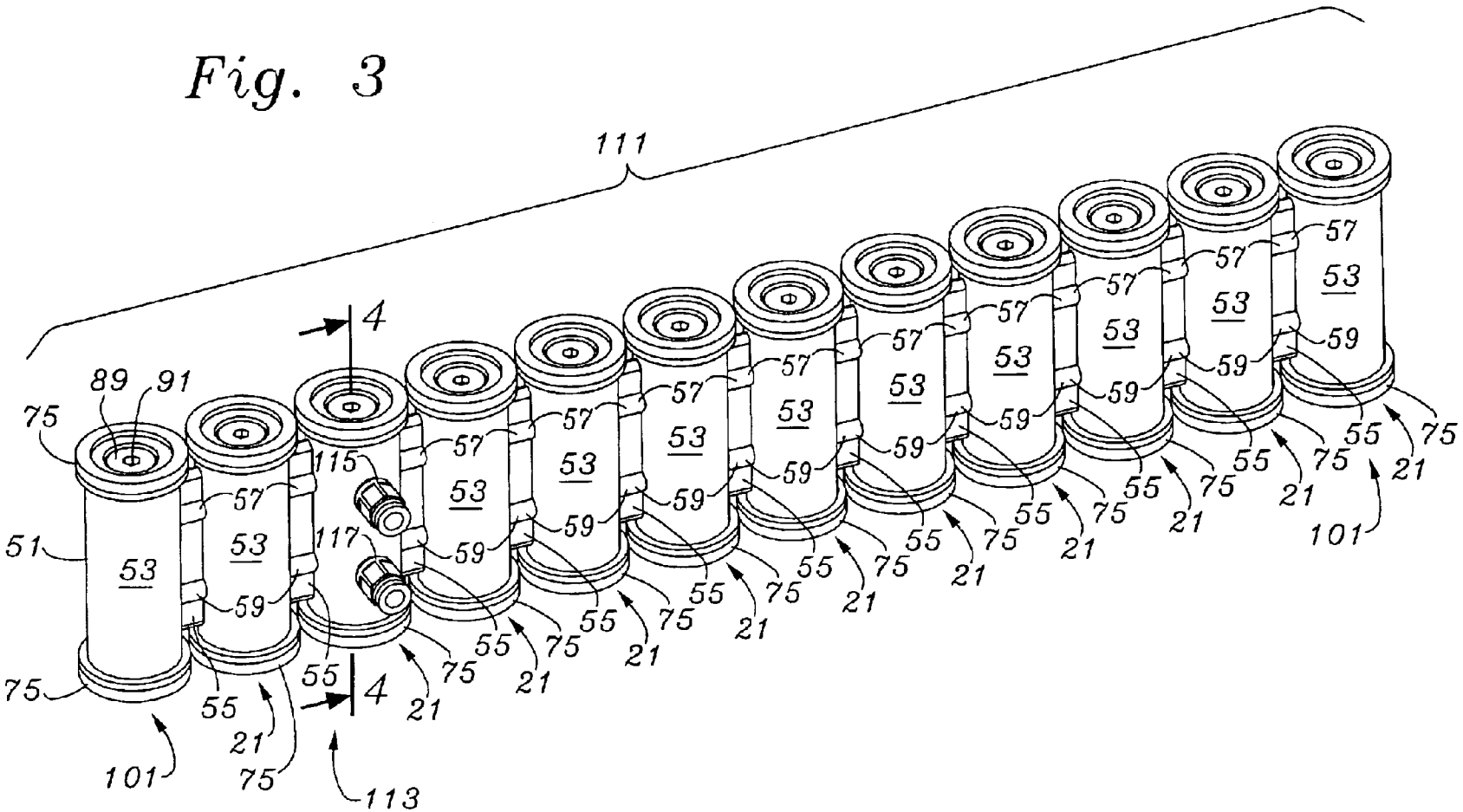
FIG. 3 is a perspective view of a support set containing twelve interconnected supports and in which the vacuum port connections are mounted in one of the supports, third from the left from the perspective of the viewer.

Referring to FIG. 3, a perspective view of a support set 111 containing twelve interconnected supports, including two end supports 101, nine supports 21, and a service support 113. Service support 113 differs from the supports 21 in that it has a pair of side fittings for the application of a vacuum source into the entire set 111. An upper threaded hose insertion fitting 115 supplies vacuum to all of the upper hardened rubber dressable members 75 seen in FIG. 3, remembering that the set 111 need only be inverted for the upper hardened rubber dressable members 75 to become lower hardened rubber dressable members 75. A lower upper threaded hose insertion fitting 117 supplies vacuum to all of the lower hardened rubber dressable members 75 seen in FIG. 3.

Figure 4:
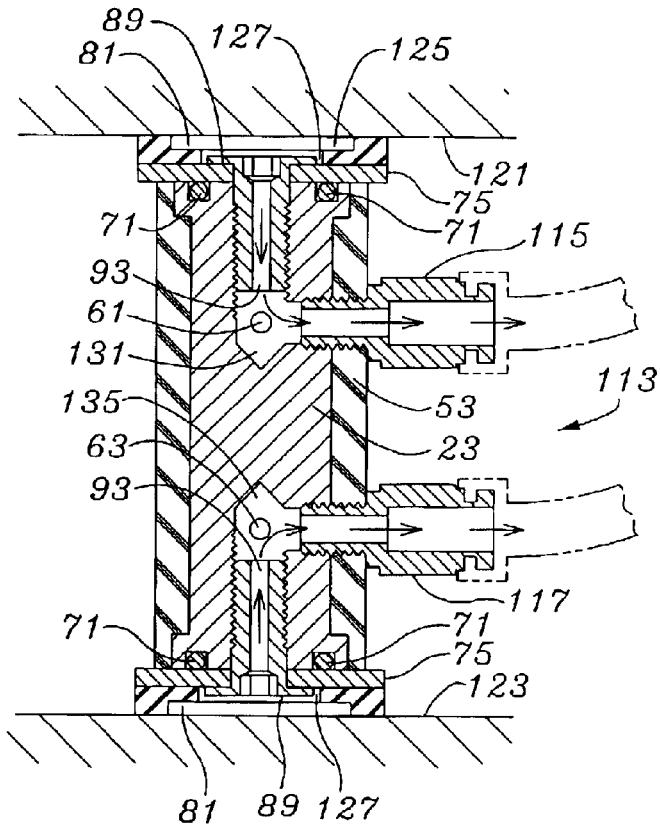
FIG. 4 is a side sectional view taken along line 4—4 of FIG. 3 and illustrates the internals of the support having vacuum port connections.

FIG. 4 is a side sectional view taken along line 4—4 of FIG. 3 and illustrating the internals of the service support 113 in its working position to further facilitate the explanation of the action of its vacuum connections. In normal engagement, the set 111, of which one support 113, the vacuum service support 113, is a member is situated between a work piece 121 and a working table surface 123.

Beginning at the top. A vacuum space 125 is created between the work piece 121 and the inner lower height annular surface 79 and flat head 89 of the threaded member 85. The diameter of the extent of the inner lower height annular surface 79 is from about one to two inches and provides a significant downward holding force on the work piece 121. Engagement of the work piece 121 is had by the upper annular surface 77 of the hardened rubber dressable member 75.

As can be seen, the hardened rubber dressable member 75 is vulcanized directly to the plate 73. A gap 127 exists between the aperture 81 of the hardened rubber dressable member 75 and the flat head 89 of the threaded member 85. As can be seen, any leakage between the head 89 and the plate 73 to the outside is not possible because of the "o" ring seal 71.

The upper and lower threaded hose insertion fittings 115 and 117 have threaded portions which engaged threaded bores in the body 23. The upper threaded hose insertion fitting 115 is in communication with an upper chamber 131 which is also in connection with aperture 61. The lower upper threaded hose insertion fitting 117 is in communication with a lower chamber 135 which is also in connection with lower aperture 63. Note that upper chamber 131, upper aperture 61 and upper threaded hose insertion fitting 115 are all completely isolated from lower chamber 135, lower aperture 63 and lower threaded hose insertion fitting 117. This enables all of the upper ends of the supports 21, 101 and 113 within set 111 to have a vacuum applied independently of the lower ends of the supports 21, 101 and 113 within set 111.

The same structures are seen below chamber 135 as were seen above upper chamber 131. It is understood that for both the service support 113 and the support 21 that the upper and lower apertures 61 and 63, respectively will be oriented for a straight pass through and would be seen to align with the upper and lower apertures 61 and 63 of the service support 113 and the support 21. The end support 101 would have upper and lower apertures 61 and 63 typically in only one side of the main cylindrical extent 25 of body 23.

However, the end support 101 may also have threaded plugs placed in the threaded upper and lower apertures 61 and 63. This brings up one of the strongest points to be made in the system which comprises the support sets 111, which is their modularity. As can be seen, the number of parts for an individual support of support sets 11, excluding the cylindrical body portion 53 and side web portions 55, and considering the parts including plate 73 and hardened rubber dressable member 75 to be a single unit, to be four in number.

As a result, the system disclosed is easily maintained with a lesser number of different parts to maintain, stock and to buy. Further, by providing a lower vacuum supportability independent from the upper vacuum supportability, the support set 111 can be machine dressed while in place on the working table 123. Such dressing in place is not only able to be performed more quickly, but enables the machine performing the dressing function to store the current height of the support sets 111 which should all be the same height. Thus it is recommended that a re-dressing operation be performed on all support sets 111 which could be used on a particular work table 123.

Figure 5:
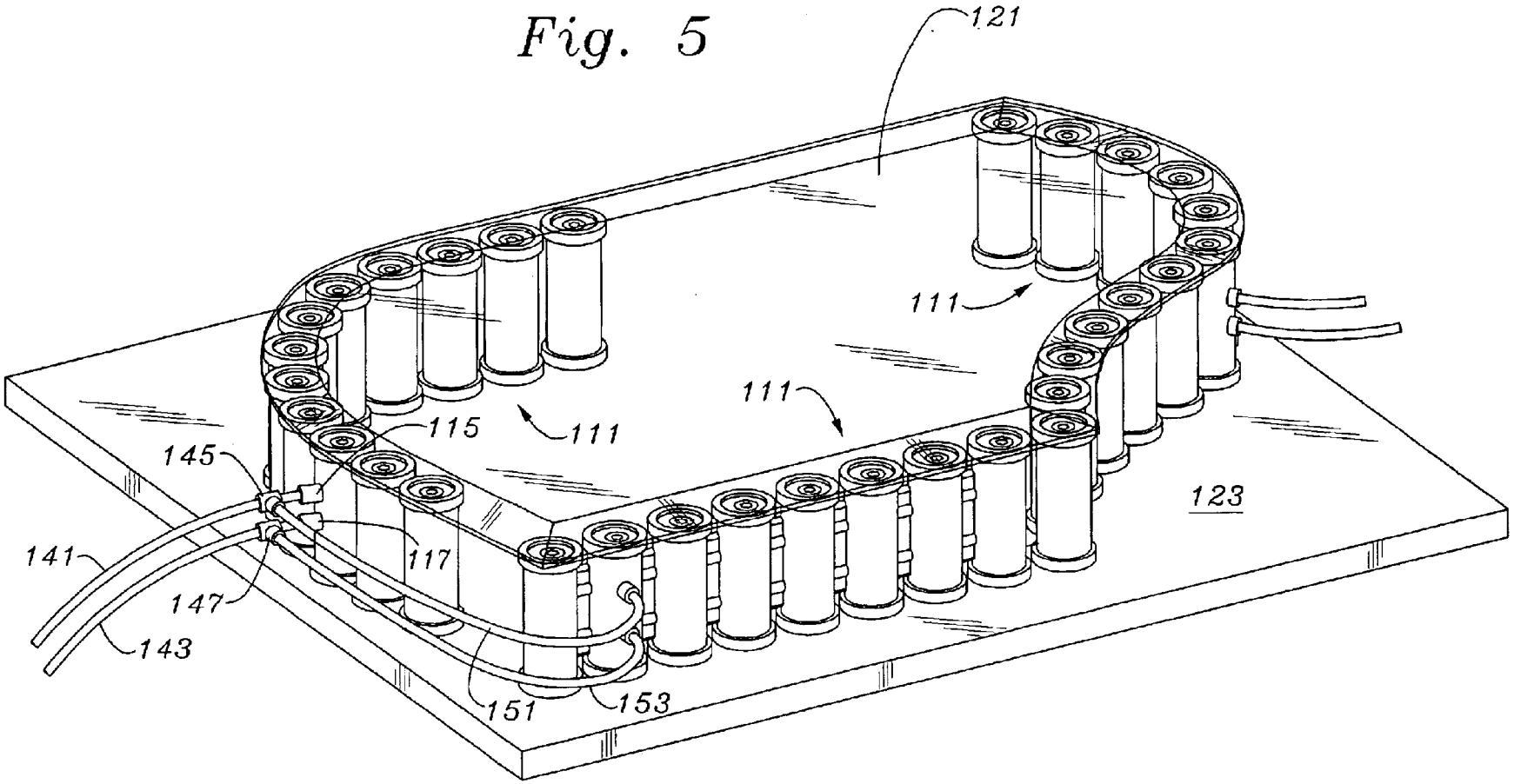
FIG. 5 is a perspective drawing of a vacuum supported piece of glass and illustrating a distributed vacuum connection between two sets of supports.

Referring to FIG. 5, a perspective drawing of a vacuum supported piece of glass (for see through clarity) as a work piece 121 is shown as supported by a set of three support sets 111. FIG. 5 also illustrates the vacuum distributability for a pair of support sets 111. A pair of vacuum hoses including an upper vacuum hose 141 and a lower vacuum hose 143 each extend to a "t" fitting 145 and a "t" fitting 147, respectively before extending through to connection to upper and lower threaded hose insertion fittings 115 and 117. From the "t" fitting 145 and 147, respectively, looping vacuum hoses including an upper vacuum hose 151 and a lower vacuum hose 153 fittings extend to upper and lower threaded hose insertion fittings 115 and 117 of another support set 111. By using "t" fittings 145 and 147, any work table 123 can have its support sets 111 controlled with a single pair of (preferably independently actuated) vacuum hoses.

In instances where the support sets 111 have been dressed and where it is possible or acceptable to actuate both top and bottom vacuums simultaneously, looping can also be accomplished between the upper and lower vacuum hoses 141 and 143 so that the system of support sets 111 can be actuated with a single vacuum hose.

While the present invention has been described in terms of a device and system used in conjunction with securing close edge support work pieces for all types of process machinery, and in particular with machinery for the milling, edging and machining of materials including glass, granite, marble, stone, and the like, one skilled in the art will realize that the structure and techniques of the present invention can be applied to many appliances. The present invention may be applied in any situation where the position of relatively less thick work pieces is desired to be precisely secured to reduce breakage and to reduce lost time.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A support set for supporting a work piece near its edge comprising:

a first support further comprising a body having a first end and a second end, said first end having a first threaded bore and said second end having a second threaded bore in fluid isolation from said first threaded bore, said body having at least a first side bore opening to an outside of said body and in communication with said first threaded bore, said body having at least a second side bore opening to an outside of said body and in communication with said second threaded bore;

a first hardened rubber dressable member having a central aperture and a first dressable surface;

a first threaded member having a first threaded member through bore extending completely through said first threaded member and threadably engaged through said central aperture of said hardened rubber dressable member and engaging said first threaded bore of said body;

a second hardened rubber dressable member having a central aperture and a second dressable surface;

a second threaded member having a second threaded member through bore extending completely through said second threaded member and threadably engaged through said central aperture of said hardened rubber dressable member and engaging said second threaded bore of said body;

a first flexible vacuum channel in fluid communication with said first side bore;

a second flexible vacuum channel in fluid communication with said second side bore;

a second support;

a second support substantially identical to said first support and wherein said first side bore of said second body is in fluid communication with said first flexible vacuum channel and wherein said second side bore of said second body is in fluid communication with said second flexible vacuum channel, said first and second vacuum channels enabling said first body to enable said first body to pivot in a substantially spaced apart linear motion with respect to said second body, and whereby a vacuum introduced at said first flexible vacuum channel is communicated through said first side bore, is transmitted through said first threaded bore, said first threaded member and an area inward of said first dressable surface of said first hardened rubber dressable member of both said first and said second supports, and whereby a vacuum introduced at said second flexible vacuum channel is communicated through said second side bore is transmitted through said second threaded bore, said second threaded member and an area inward of said second dressable surface of said second hardened rubber dressable member of both said first and said second supports, to enable vacuum support to be had from a work table engaged by one of said first and said second dressable surfaces to be transmitted to a work piece through said first and second supports and to a work piece engaged by the other of said first and said second dressable surfaces of said first and second supports.

2. The support set as recited in claim 1 wherein a first and second flexible vacuum channels are carried in a common structure.

3. The support set as recited in claim 2 wherein said common structure is a web engaging said body.

4. The support set as recited in claim 3 wherein said web includes a cylindrical body portion surrounding each of said first and said second bodies.

5. The support set as recited in claim 2 wherein said first and said seconds ends both include a slot and further comprising an "o" ring seal within each of said slots.

6. The support set as recited in claim 2 wherein each said first and said second hardened rubber dressable members further comprise:

a plate having a first side, a second side and an aperture, and a volume of hardened dressable rubber vulcanized to said first side of said plate.

7. The support set as recited in claim 1 wherein said body of one of said first and second supports further includes at least a third side bore opening to an outside of said body and in communication with said first threaded bore for transmitting a vacuum from said first threaded bore beyond said body, said body further including at least a fourth side bore opening to an outside of said body and in communication with said second threaded bore for transmitting a vacuum from said second threaded bore beyond said body.

8. The support set as recited in claim 1 wherein one of said plurality of said bodies includes a first hose insertion fitting in fluid communication with said first threaded bore and a second hose insertion fitting in fluid communication with said second threaded bore.

9. The support set as recited in claim 1 wherein said first and second side bores extend completely through at least one of said first and second bodies.

* * * * *